US005390730A

United States Patent [19]

Goelzer

[11] Patent Number: 5,390,730

[45] Date of Patent: Feb. 21, 1995

[54] FLUID COOLING SYSTEM

[75] Inventor: John V. Goelzer, Cedarburg, Wis.

[73] Assignee: Sterling, Inc., Milwaukee, Wis.

[21] Appl. No.: 68,637

[22] Filed: May 27, 1993

[51] Int. Cl.[6] ..... F28F 9/22

[52] U.S. Cl. ..... 165/108; 165/143; 165/145; 165/161

[58] Field of Search ..... 165/145, 143, 161, 108

[56] References Cited

U.S. PATENT DOCUMENTS

| | | | |
|---|---|---|---|
| 290,929 | 12/1883 | Rew . | |
| 345,593 | 7/1886 | Hughes . | |
| 367,839 | 8/1887 | Oakes . | |
| 472,671 | 4/1892 | Jacobs . | |
| 626,924 | 6/1899 | Ortmans . | |
| 988,661 | 4/1911 | Power . | |
| 1,355,980 | 10/1920 | Jones . | |
| 1,810,165 | 6/1931 | Frank et al. | 165/143 |
| 2,346,104 | 4/1944 | Gunter . | |
| 2,468,903 | 5/1949 | Villiger . | |
| 2,610,485 | 9/1952 | Barr . | |
| 2,657,019 | 10/1953 | Schmitt . | |
| 3,479,839 | 11/1969 | Scott . | |
| 3,507,323 | 4/1970 | Ronnholm et al. . | |
| 3,749,160 | 7/1973 | Vestre . | |
| 3,776,302 | 12/1973 | Waszink et al. . | |
| 4,257,356 | 3/1981 | Minnick . | |
| 4,519,444 | 5/1985 | Sebald | 165/145 |
| 4,753,773 | 6/1988 | Garabedian et al. . | |
| 4,815,533 | 3/1989 | Harada et al. . | |

*Primary Examiner*—Albert W. Davis, Jr.

*Attorney, Agent, or Firm*—Andrus, Sceales, Starke & Sawall

[57] ABSTRACT

A vessel-type fluid cooling system includes an upper mixing chamber and a lower holding chamber, the chambers being separated by a transverse separating wall. One or more cooling tubes extend between the mixing chamber and the holding chamber, and cooling elements, such as fluid-cooled tubes, are located within each cooling tube. A heated fluid inlet provides heated fluid to the mixing chamber, and a cooled fluid outlet discharges cooled fluid from the holding chamber. Each cooling tube includes one or more inlets toward its upper end, and fluid is supplied from the mixing through the inlets to passages defined by the cooling tubes for cooling the fluid as the fluid flows downwardly through the cooling tubes. The cooled fluid is discharged into the holding chamber. Flow of cooled fluid through the cooling tubes functions to pre-cool fluid contained within the mixing chamber, so that fully heated fluid is not exposed directly to the cooling elements, thereby avoiding flashing of the fluid which otherwise may occur.

10 Claims, 1 Drawing Sheet

FLUID COOLING SYSTEM

BACKGROUND AND SUMMARY

This invention relates to a system for cooling of fluid, and more particularly to a tank-type fluid cooling system in which fluid is cooled as it flows through the tank.

Various cooling tank constructions are known in the prior art. For example, it is known to provide a cooling tank having elongated U-shaped cooling elements, in which the tank defines a flow path including a first vertical portion and a second vertical portion, with a leg of each cooling element being disposed in one of the vertical flow path portions. The fluid first flows downwardly through the first flow path portion then upwardly through the second flow path portion, being cooled by the cooling elements during fluid flow. The fluid is then discharged from the second flow path portion. Other patents disclose heat exchanger systems in which a series of cooling tubes extend through a tank, with cooled fluid being supplied to the cooling tubes. Heated fluid to be cooled is supplied to the portion of the tank through which the cooling tubes extend, and flows past the cooling tubes to cool the fluid prior to discharge from the tank.

It is an object of the present invention to provide-a fluid cooling system utilizing flow of fluid through a vessel to cool the fluid, with the vessel operating in a simple and efficient manner to cool the fluid during fluid flow therethrough. It is a further object of the invention to provide a fluid cooling system which functions to prevent flashing upon contact of the fluid with the fluid cooling elements associated with the fluid cooling system. Yet another object of the invention is to provide a tank-type cooling system capable of holding a quantity of cooled fluid prior to discharge of the cooled fluid from the tank.

In accordance with the invention, a fluid cooling system includes a vessel which defines a first cavity and a second cavity separated by a wall. The vessel includes an inlet for introducing heated fluid to the first cavity and an outlet for discharging cooled fluid from the second cavity. One or more cooling tubes are disposed within the vessel, with each cooling tube defining an internal passage and having one or more inlet openings establishing communication between the first cavity and the cooling tube internal passage. Each cooling tube further defines an outlet establishing communication between the cooling tube internal passage and the second cavity. A cooling assembly is incorporated into the system, and includes a series of elongated cooling elements which extend into and partially through the cooling tube internal passage. With this arrangement, the heated fluid is first introduced into the first cavity, and then into the inlet of the cooling tube. The fluid then flows through the internal passage of the cooling tube to be cooled, and the cooled fluid is discharged into the second cavity. The cooled fluid passing through the cooling tube functions to pre-cool the heated fluid which surrounds the cooling tube in the first cavity, and the heated fluid introduced into the first cavity through the inlet is mixed with the pre-cooled fluid prior to passage of the fluid into the cooling tube inlets. In this manner, the hot inlet fluid is not introduced directly to the cooling elements, so as to prevent the fluid from flashing when it initially contacts the cooling elements.

In accordance with other aspects of the invention, the first and second cavities defined by the vessel are in the form of upper and lower cavities separated by a transverse wall located within the vessel. The one or more cooling tubes extend between the upper end of the upper cavity through the transverse wall, in a substantially vertical direction. The one or more inlet openings of each cooling tube are located toward the upper end of each cooling tube, and the vessel inlet is located toward the lower end of the upper cavity adjacent the transverse wall. In this manner, the hot inlet fluid is routed upwardly through the upper cavity to the cooling tube inlet openings, for thoroughly mixing with the pre-cooled fluid prior to entrance into the cooling tube inlet openings. The upper extent of the upper cavity is defined by an upper transverse wall of the vessel, and the one or more cooling tubes extend downwardly through the one or more openings in the transverse upper vessel wall. The cooling elements extend from a cooling head, and the cooling head is interconnected with the transverse upper vessel wall adjacent one of the openings to mount the cooling assembly to the vessel.

The invention further contemplates a method of cooling fluid during flow of fluid through a vessel, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
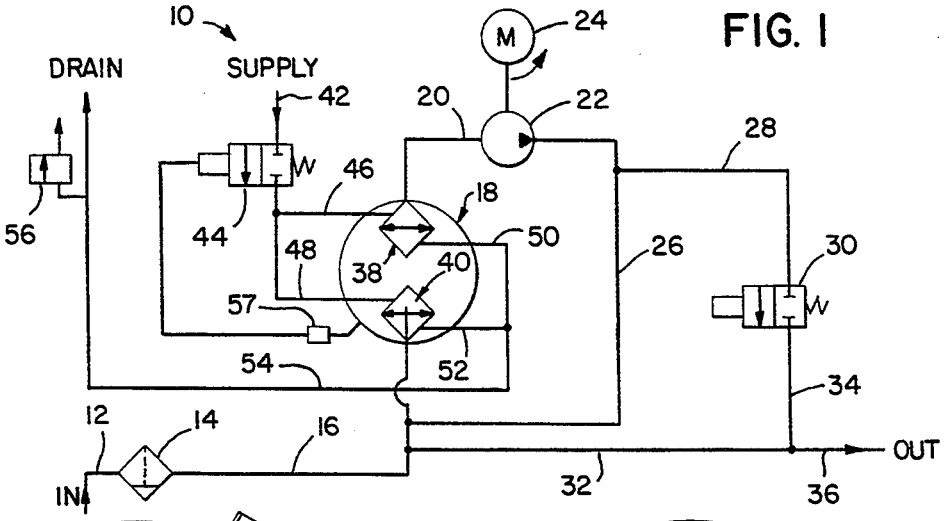
FIG. 1 is a schematic view of a portion of a fluid system into which the vessel-type cooling system of the invention is incorporated.

FIG. 1 illustrates a fluid cooling system 10 for use in any application in which it is desired to cool a fluid, such as a fluid process medium utilized in an injection molding system or the like in which the molding dies are intermittently cooled by circulating cooled fluid through water jackets in the mold. A system of this type is available from Sterling, Inc. of Milwaukee, Wis., the assignee of the present application, under its designation "STERLCOOL" CFP Series. System 10 is adapted to cool any process medium, typically a liquid medium such as water or oil.

System 10 includes a heated liquid supply line 12 which returns the process medium to system 10 from the process in which the medium is used for cooling purposes, such as from an injection molding die of the like. Supply line 12 connects to a strainer 14, and a line 16 extends between strainer 14 and the inlet of a cooling vessel 18, constructed according to the invention.

A line 20 is interconnected with the outlet of cooling vessel 18, and a pump 22 powered by a motor 24 is interconnected with line 20. A line 26 is connected to the outlet of pump 22 at one end, and at its other end with line 16. A line 28 is interconnected with line 26 and with a solenoid valve 30. A bypass line 32 is interconnected with line 16, and a line 34 extends between solenoid valve 30 and line 32. A discharge line 36 extends from the junction of lines 32 and 34.

A pair of heat exchanger water boxes 38, 40 are mounted to the upper end of cooling vessel 18, in a manner to be explained. A cold water supply line 42 is interconnected with a solenoid control valve 44, which supplies cold water to heat exchanger water boxes 38, 40 through a pair of lines 46, 48, respectively. Return water from heat exchanger water boxes 38, 40 is supplied through lines 50, 52, respectively to a drain line 54, which may interconnect with a chiller (not shown) which functions to cool the heated water in drain line 54 and return chilled water to cold water supply line 42. Alternatively, cold water may be supplied to water supply line 42 from the plant water supply. A pressure relief valve 56 is interconnected in drain line 54. A thermostat 57 is interconnected with cooling vessel 18 and with solenoid valve 44, for controlling the supply of cold water to vessel 18 from supply line 42 in response to the sensed temperature of the water in vessel 18.

Figure 2:
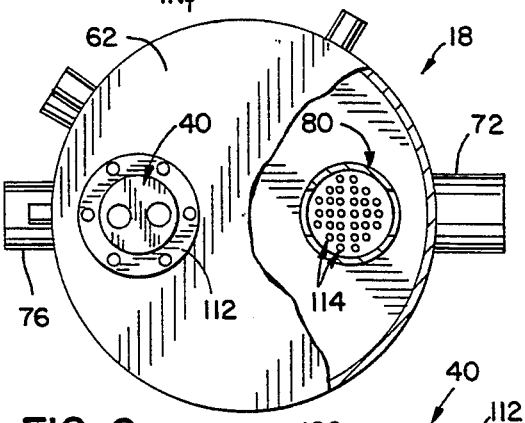
FIG. 2 is a top plan view, with a portion broken away, of the vessel-type cooling system of the invention.
Figure 4:
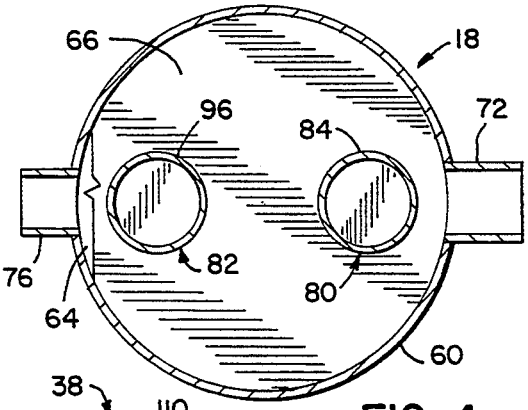
FIG. 4 is a section view taken along line 4—4 of FIG. 3.
Figure 3:
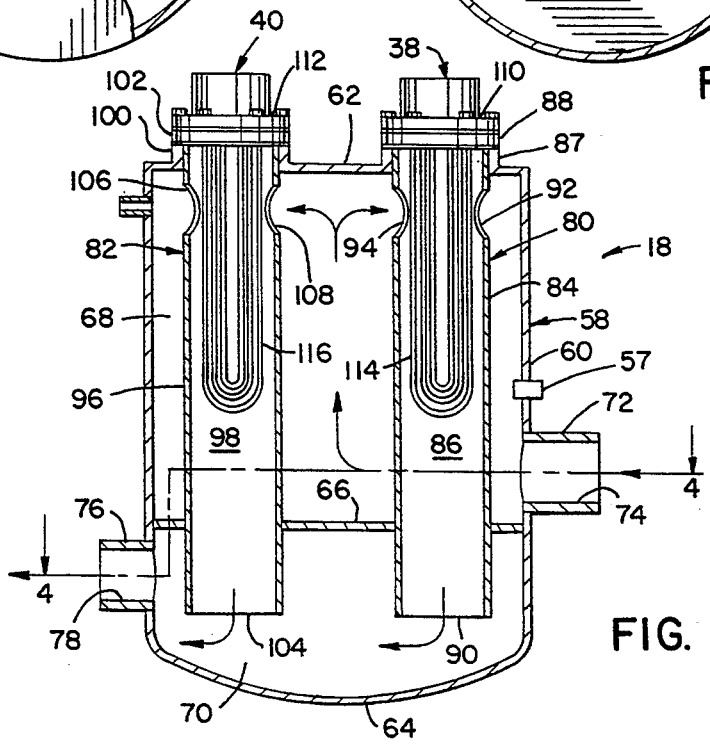
FIG. 3 is a longitudinal section view of the vessel-type cooling system of FIG. 2.

The construction of cooling vessel 18 is illustrated in FIGS. 2–4. Referring to FIG. 3, cooling vessel 18 consists of a generally cylindrical tank 58 defining a side wall 60, an upper wall 62 and a lower wall 64. A transverse horizontal separating wall 66 is interconnected with the inner surface of tank side wall 60 throughout its outer periphery, to separate the interior of tank 58 into an upper mixing chamber or reservoir 68 and a lower holding chamber or reservoir 70. Upper mixing chamber 68 is defined by tank upper wall 62, separating wall 66 and side wall 60 of tank 58. Similarly, holding chamber 70 is defined by tank lower wall 64 in combination with separating wall 66 and the lower portion of tank side wall 60. An inlet nipple 72 is connected to tank side wall 60, defining an internal passage 74 which establishes communication between line 16 and mixing chamber 68 for supplying heated fluid to mixing chamber 68. An outlet nipple 76 is connected to the lower portion of tank side wall 60, defining an internal passage 78 in communication with holding chamber 70. Discharge line 20 is interconnected with outlet nipple 76, for establishing communication between holding chamber 70 and discharge line 20. Inlet nipple 72 is located above and closely adjacent separating wall 66, and outlet nipple 76 is located below and closely adjacent separating wall 66. With this arrangement, inlet passage 74 supplies heated fluid to the lower extent of heating chamber 68, and cooled fluid is discharge through outlet passage 78 from the upper portion of holding chamber 70.

As shown in FIG. 3, tank 58 is generally cylindrical, extending along a longitudinal axis. Separating wall 66 is oriented perpendicular to the longitudinal axis of tank 58.

A pair of identical cooling tubes 80, 82 are located in the interior of tank 58. Cooling tubes 80, 82 are oriented parallel to the longitudinal axis of tank 58.

Cooling tube 80 defines a side wall 84 and an internal passage 86. The upper end of cooling tube 80 extends into a passage defined by a flange 87 extending upwardly from tank upper wall 62. A tube sheet 88 is retained between the upper end of flange 87 and water box 38. Cooling tube 80 extends downwardly through an opening formed in separating wall 66, such that its outlet 90 is located within holding chamber 70. The edges of separating wall 66 and the adjacent portion of cooling tube side wall 84 are interconnected such as by welding or the like. Cooling tube 80 defines a pair of inlet openings 92, 94 located toward the upper end of mixing chamber 68. Inlet openings 92, 94 establish communication between mixing chamber 68 and internal passage 86 of cooling tube 80.

As noted, cooling tube 82 is identical in construction to cooling tube 80. Cooling tube 82 includes a side wall 96 defining an internal passage 98. The upper end of cooling tube 82 extends into a passage defined by a flange 100 extending upwardly from tank upper wall 62, and a tube sheet 102 is retained between the upper end of flange 100 and water box 40. Cooling tube 82 extends downwardly through an opening formed in separating wall 66, such that its outlet 104 is located within holding chamber 70. As with cooling tube 80, the edges of separating wall 66 and the adjacent portion of cooling tube side wall 96 are interconnected such as by welding or the like. Cooling tube 82 further defines a pair of inlet openings 106, 108 located toward the upper end of mixing chamber 68. Inlet openings 106, 108 establish communication between mixing chamber 68 and internal passage 98 of cooling tube 82.

As shown in FIGS. 2 and 3, heat exchanger water boxes 38, 40 include integral flanges 110, 112, respectively, which are secured such as by bolts or the like through tube sheets 88, 102, respectively to flanges 87, 100, respectively. A series of elongated U-shaped cooling tubes 114, 116 extend downwardly from heat exchanger tube sheets 88, 102, respectively. In a conventional manner, cooling tubes 114, 116 are supplied with cold water through heat exchanger water boxes 38, 40, respectively.

This construction, and the manner in which water boxes 38, 40 and their associated cooling tubes 114, 116, respectively, are mounted to vessel 18, provides easy removal and replacement of cooling tubes 114, 116 as necessary for service and/or replacement. For example, to remove cooling tubes 114, an operator simply removes the bolts which extend through water box flange 110 and into mounting flange 87. The entire cooling assembly is then removed, consisting of water box 38 and its flange 110, tube sheet 88 and cooling tubes 114. This assembly can then be serviced as necessary, or replaced with an identical cooling assembly.

As an alternative to the construction of cooling tubes 80, 82 and the illustrated configuration of cooling elements 114, 116, it is also contemplated that cooling tubes 80, 82 could be extended so as to extend through vessel bottom wall 64, and discharge openings formed in the lower end of cooling tubes 80, 82 establishing communication between cooling tube internal passages 86, 98, respectively and holding chamber 70. With this arrangement, rather than U-shaped cooling elements such as 114, 116, straight-through linear cooling elements are employed, extending the entire distance between vessel upper wall 62 and vessel lower wall 64. A mounting arrangement similar to that illustrated for cooling tubes 114, 116 is employed at both the upper and lower ends of vessel 18 to accommodate the passage of the straight-through cooling elements through both the upper and lower vessel walls. Any other satisfactory cooling arrangement for cooling fluid as it flows through cooling tubes 80, 82 could also be employed.

In operation, cooling vessel 18 functions as follows. Warm inlet fluid is supplied to inlet passage 74 through line 16, passing into mixing chamber 68. In mixing chamber 68, the heated inlet fluid is mixed with fluid already in mixing chamber 68. The fluid within mixing chamber 68 then flows upwardly, into and through inlet passages 92, 94 of cooling tube 80 and inlet passages 106, 108 of cooling tube 82, and then downwardly through passages 86, 98 of cooling tubes 80, 82, respectively. The cooled fluid is then discharged through outlets 90, 104 of cooling tubes 80, 82, into holding chamber 70. Thereafter, the cooled fluid is discharged from cooling vessel 18 through outlet passage 78 to line 20 for recirculation. Pump 22 and its motor 24 function to constantly recirculate fluid between inlet passage 74 and outlet passage 78, even when cooled fluid is not required by system 10. Thermostat 57 functions to supply cold water to water boxes 38, 40 when the temperature of the fluid in mixing chamber 68 exceeds a predetermined level. Thermostat 57 is adjustable, so that the thresh-old temperature can be changed as desired according to the desired temperature of fluid to be maintained within mixing chamber 68. Alternatively, thermostat 57 could be mounted to vessel 18 so as to detect the temperature of fluid in holding chamber 70, to ensure a supply of fluid therein at a predetermined temperature. In this manner, a constant supply of cooled fluid is held by holding chamber 70 so that, when cooled fluid is demanded by system 10, typically in response to a thermostat or the like, the cooled fluid maintained within holding chamber 70 is immediately available. Preferably, holding chamber 70 is sized so as to provide sufficient cooled fluid to satisfy the immediate requirements of the process in which fluid system 10 is connected, such as for cooling an injection molding die or the like.

Flow of cooled fluid through passages 86, 98 of cooling tubes 80, 82, respectively functions to pre-cool fluid contained within mixing chamber 68 through side walls 84, 96 of cooling tubes 80, 82, respectively. In this manner, the temperature of the fluid contained within mixing chamber 68 is lowered prior to entry of fluid into inlet openings 92, 94, 106 and 108, such that the fully heated fluid is not exposed directly to cooling elements 114, 116. This functions to avoid flashing which otherwise may occur upon direct contact of the fully heated fluid with cooling elements 114, 116.

Various alternatives and embodiments are contemplated as being within the scope of the following claims particularly pointing out and distinctly claiming the subject matter regarded as the invention.

I claim:

1. A fluid cooling system, comprising:

a vessel having an outer wall and defining a first cavity and a second cavity separated by an inner wall, the vessel including an inlet in the outer wall located adjacent the inner wall for introducing fluid to the first cavity and an outlet communicating directly through the vessel wall with the second cavity for discharging fluid from the second cavity, the outlet being thermally isolated from the first cavity;

one or more cooling tubes disposed within the vessel, each cooling tube defining an internal passage and having one or more inlet openings establishing communication between the first cavity and the cooling tube internal passage, and an outlet establishing communication between the second cavity and the cooling tube internal passage; and cooling means disposed within each cooling tube internal passage.

2. The system of claim 1, wherein the vessel defines a longitudinal axis, and wherein the first and second cavities defined by the vessel comprise upper and lower cavities, and wherein the vessel inner wall comprises a transverse wall oriented perpendicular to the vessel longitudinal axis located within the vessel and separating the first and second cavities.

3. The system of claim 2, wherein the upper cavity defines an upper end and a lower end defined by the transverse wall, and wherein the one or more cooling tubes extend downwardly from the upper end of the upper cavity through the transverse wall.

4. The system of claim 3, wherein the one or more inlet openings are located toward the upper end of each cooling tube.

5. The system of claim 3, wherein upper extent of the upper cavity is defined by an upper transverse vessel wall, and wherein the one or more cooling tubes extend downwardly through the one or more openings in the transverse upper vessel wall.

6. The system of claim 5, wherein the cooling means in each of the one or more cooling tubes comprises a cooling assembly including a plurality of elongated cooling elements depending from a cooling head, wherein the cooling head is interconnected with the transverse upper vessel wall adjacent one of the openings therein to mount the cooling assembly to the vessel.

7. A method of cooling fluid, comprising the steps of:

providing a vessel having an outer wall and defining an upper mixing reservoir and a lower holding chamber separated by an inner wall;

introducing the fluid into the lower extent of the mixing reservoir adjacent the inner wall;

routing the fluid upwardly through the mixing reservoir to a cooling tube disposed within the mixing reservoir through a cooling tube inlet disposed within the upper extent of the mixing reservoir, the cooling tube including cooling means, wherein passage of the fluid through the cooling tube functions to cool the fluid;

discharging the cooled fluid from the cooling tube to the holding chamber through the inner wall;

wherein the cooling tube functions to pre-cool fluid located within the mixing reservoir prior to passage of the fluid into the cooling tube through the cooling tube inlet; and discharging the fluid from the holding chamber via an outlet communicating through the vessel outer wall with the holding chamber.

8. The method of claim 7, wherein the mixing reservoir is defined by an upper wall of the vessel in combination with the vessel inner wall and the vessel outer wall.

9. The method of claim 8, wherein the holding chamber is defined by a lower wall of the vessel in combination with the vessel inner wall and the vessel outer wall.

10. A fluid cooling system, comprising:

a vessel defining a mixing reservoir and a holding chamber, the vessel including an inlet for introducing fluid into the mixing reservoir and an outlet for discharging fluid from the holding chamber;

one or more cooling tubes disposed within the vessel, each cooling tube defining an internal passage and having one or more inlet openings establishing communication between the mixing reservoir and the cooling tube internal passage, and an outlet establishing communication between the holding chamber and the cooling tube internal passage;

cooling means disposed within each cooling tube internal passage; and a recirculating system interconnected between the mixing reservoir and the holding chamber for recirculating cooled fluid from the holding chamber to the mixing reservoir.

* * * * *